United States Patent [19]

Metz et al.

[11] Patent Number: 4,955,281

[45] Date of Patent: Sep. 11, 1990

[54] COUNTERRECOIL BLOCKING DEVICE

[75] Inventors: Josef Metz, Neuss; Hans Hülsewis, Ratingen, both of Fed. Rep. of Germany

[73] Assignee: Rheinmetall GmbH, Duesseldorf, Fed. Rep. of Germany

[21] Appl. No.: 390,393

[22] Filed: Aug. 7, 1989

[30] Foreign Application Priority Data

Aug. 5, 1988 [DE] Fed. Rep. of Germany ..... 3826652

[51] Int. Cl.[5] ..... F41A 25/02

[52] U.S. Cl. ..... 89/43.01; 89/4.2

[58] Field of Search ..... 89/4.2, 24, 43.01, 43.02, 89/170, 178

[56] References Cited

U.S. PATENT DOCUMENTS 283,688 8/1883 Vavasseur ..... 89/43.01

345,744 7/1886 Vavasseur ..... 89/43.01

4,632,011 12/1986 Metz et al. ..... 89/36.13

4,738,182 4/1988 Nordmann ..... 89/33.4

*Primary Examiner*—Stephen C. Bentley

*Attorney, Agent, or Firm*—Spencer & Frank

[57] ABSTRACT

A gun includes a barrel arranged to execute a recoil and a counterrecoil after a shot is fired; a trunnion about which the barrel is pivotal in a vertical plane to assume an index position and firing positions situated at an angle to the index position; a case ejector for ejecting a case from the barrel during counterrecoil; and a counterrecoil blocking device for interrupting the counterrecoil as long as the barrel is in a firing position other than the index position and for allowing the counterrecoil to resume when the barrel assumes the index position, whereby case ejection by the case ejector is effected in the index position.

8 Claims, 2 Drawing Sheets

FIG.1
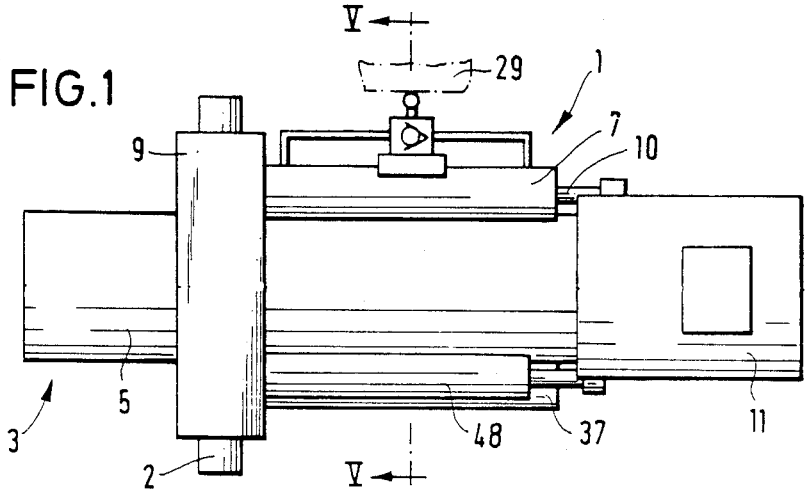
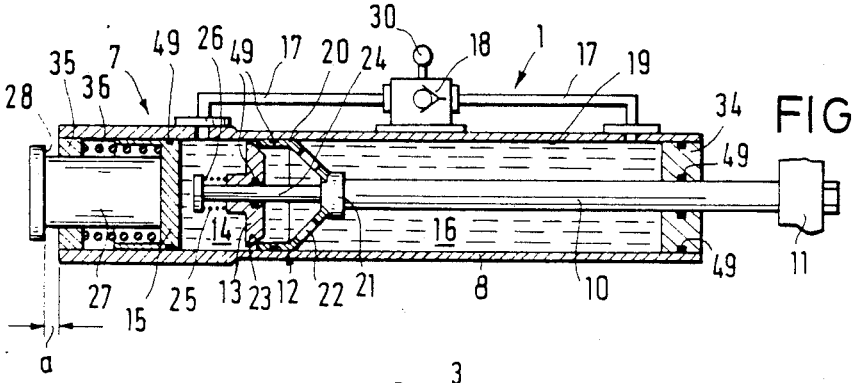
FIG.2
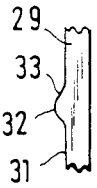
FIG.4
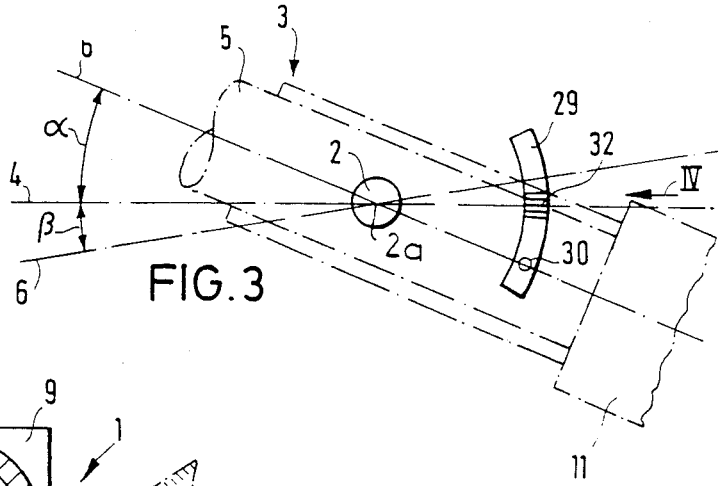
FIG.3
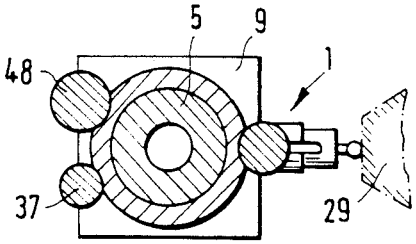
FIG.5

COUNTERRECOIL BLOCKING DEVICE

CROSS REFERENCE TO RELATED APPLICATION

This application claims the priority of Federal Republic of Germany Application No. P 38 26 652.0 filed Aug. 5th, 1988 which is incorporated herein by reference.

BACKGROUND OF THE INVENTION

The present invention relates to a device to ensure automatic ejection of cases for a cannon which can be adjusted in elevation about a trunnion.

It is known, as disclosed, for example, in U.S. Pat. No. 4,632,011, to collect empty cartridge cases in the turret of a tank by means of a case remover and to then eject the cases from the tank turret.

It is also known, as disclosed, for example, in U.S. Pat. No. 4,738,182, to eject empty cartridge cases from the rear of the turret by means of an automatically driven ejector device.

In both prior art constructions, however, two process steps are required to remove the empty cartridge cases from the turret. First, in the firing position, after a round has been fired, the empty cases are transported, by means of a case ejector fastened to the breech ring and movable by way of the opening movement of the wedge-type breechblock, from the chamber into the above-noted ejector devices which, in the second process step, remove the cartridge cases from the turret. The second process step takes place immediately before the gun barrel is loaded in the required index position.

A direct, that is, simultaneous, removal of the empty cartridge cases from the chamber and the turret solely by the case ejector performing the first process step is not possible with the prior art structures, because in cannons of this type the counterrecoil of the gun barrel takes place exclusively in the firing position.

SUMMARY OF THE INVENTION

It is an object of the present invention to provide a gun barrel with a device which, once the gun barrel has assumed an index position, permits direct, automatic case ejection out of the turret during counterrecoil of the gun barrel.

This object and others to become apparent as the specification progresses, are accomplished by the invention, according to which, briefly stated, the gun includes a barrel arranged to execute a recoil and a counterrecoil after a shot is fired; a trunnion about which the barrel is pivotal in a vertical plane to assume an index position and firing positions situated at an angle to the index position; a case ejector for ejecting a case from the barrel during counterrecoil; and a counterrecoil blocking device for interrupting the counterrecoil as long as the barrel is in a firing position other than the index position and for allowing the counterrecoil to resume when the barrel assumes the index position, whereby case ejection by the case ejector is effected in the index position.

By virtue of the counterrecoil blocking device according to the invention, the ejection of casings may be advantageously effected during the counterrecoil phase by means of the case ejector which is mounted on the breech ring and which throws the casings out of the turret in one step. Thus, disadvantages pertaining to the coordination of a case ejector disposed outside the weapon with automatic loading devices are eliminated, since the external case ejector need no longer be present. Moreover, the immediate removal of the hot metal cases from the turret eliminates smoke generation within the turret.

In a further advantageous feature of the invention, the counterrecoil blocking device is fastened on the side of the barrel cradle so that the space needed for loading devices behind the weapon is not encumbered. Thus, the weapon is immediately ready for the next loading process as soon as the case has been ejected.

According to a further feature of the invention, the counterrecoil blocking device is a hydraulic piston/cylinder unit which simply and reliably interrupts the counterrecoil of the gun barrel by closing an internal check valve until an external valve which can be actuated exclusively in the index position of the gun barrel, has opened a bypass line for continuation of the forward movement of the gun barrel.

BRIEF DESCRIPTION OF THE DRAWING

FIG. 1 is a schematic top plan view of a preferred embodiment of the counterrecoil blocking device according to the invention, arranged laterally of the gun cradle.

FIG. 2 is a longitudinal sectional view of the counterrecoil blocking device according to the preferred embodiment.

FIG. 3 is a schematic side elevational view of a gun barrel and a stationary guide.

FIG. 4 is a view of the guide of FIG. 3, as seen in the direction of arrow IV.

FIG. 5 is a sectional view along line V—V of FIG. 1.

DESCRIPTION OF THE PREFERRED EMBODIMENT

Figure 6:
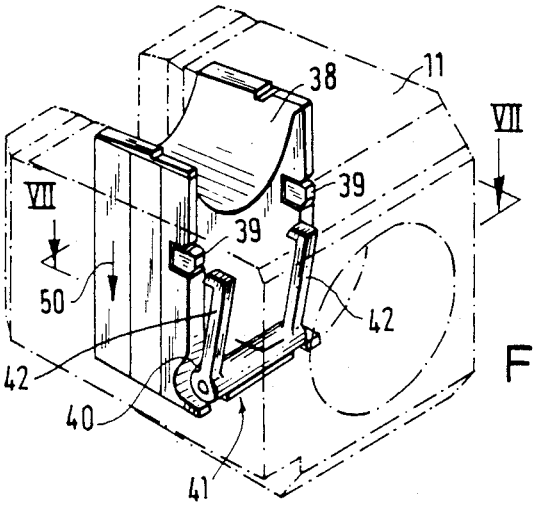
FIG. 6 is a perspective view of a breech ring including a wedge-type breechblock and a case ejector.

FIG. 1 illustrates a gun 3 which can be adjusted in elevation about a trunnion 2 and which includes a breech ring 11 fastened to the rear of gun barrel 5. Also referring to FIG. 5, a device 1 for blocking counterrecoil is disposed on the side of a cradle 9 which is pivotal about the trunnion 2. The device 1 cooperates with the breech ring 11 which is part of the recoiling masses and with a guide 29 fixed to the turret (not shown). On the side of the gun barrel 5, opposite the device 1, there are fastened a known gun barrel recoil brake 48 and a known recuperator 37.

FIG. 2 illustrates in detail the counterrecoil blocking device 1. Also referring to FIG. 3, the device 1 is operative in every firing position 6 which deviates from the index position 4 of gun barrel 5 over an angular range $\alpha$ and $\beta$ until gun barrel 5 has assumed the index position 4. The device 1 is essentially formed of a hydraulic piston/cylinder unit 7, a check valve 13 integrated therein, a heat compensation piston 15 and an externally disposed releasable (openable) valve 18.

The hydraulic piston/cylinder unit 7 is composed of a thin-walled cylinder 8 and is connected with the cradle 9 in a manner not shown. At one end, the cylinder 8 is closed by a bearing bush 34 through which a piston rod 10 passes, while the other end of the cylinder 8 is closed by a guide 35 supporting the heat compensation piston 15.

At its end outside the cylinder 8, the piston rod 10 is connected with the breech ring 11 while a hollow piston 12 is disposed at its other end, dividing the cylinder 8 into cylinder chambers 14 and 16. The hollow piston 12 is composed of a cylindrical tube 20 in contact with interior wall face 19 of the cylinder 8 and a conical member 21 which is connected with the piston rod 10 and which is provided with passage bores 22. The outer open end of the cylindrical tube 20 is provided with a seat 23 for the check valve 13.

The check valve 13 which assumes its closed position when engaging the seat 23 of the piston 12, is arranged to slide on a rod guide 24 connected with piston rod 10 and is urged into its closed position by a compression spring 25 surrounding the rod guide 24 and supported by an abutment 26 of rod guide 24 at the free end thereof. Suitable sealing elements 49 are provided to seal zones of the piston 12, the valve 13, the heat compensation piston 15 and the bearing bush 34.

During recoil of the gun barrel 5, the piston rod 10 and the piston 12 move towards the right (as seen in FIG. 2) relative to the cylinder 8, as a result of which hydraulic pressure shifts the check valve 13 off its seat 23 against the force of the valve closing spring 25, whereby the hydraulic medium flows from the cylinder chamber 16 surrounding piston rod 10 through bores 22 into cylinder chamber 14 ahead of check valve 13. During counterrecoil of the gun barrel, the piston rod 10 and the piston 12 move towards the left into the cylinder 8, whereby the spring 25 — aided by hydraulic pressure — closes the check valve 13, whereby the recuperating motion (counterrecoil) of the barrel 5 is interrupted, as will be described in further detail below.

The heat compensation piston 15 bounding the cylinder chamber 14 opposite the check valve 13 includes a collarshaped abutment 28 which limits its stroke and which is fastened outside of cylinder 8 to the heat compensation piston 15 by way of a guide tube (cylindrical guide member) 27. Due to the fact that the stroke of the heat compensation piston 15 is limited by the abutment 28, the heat compensation piston 15 is able to follow, as urged by a spring 36, the piston 12 and the hydraulic medium released by piston rod 10, only over the limited stroke length a. Thus, during recoil of the gun barrel, the outwardly moving piston rod 10 produces a shortage of volume (negative volume) of hydraulic fluid in cylinder chamber 14 which is not compensated by the heat compensation piston 15.

During counterrecoil of the gun barrel, the piston rod 10 is pushed back into the cylinder 8. The closed check valve 13 prevents the return flow of hydraulic medium from the cylinder chamber 14 into the cylinder chamber 16. After completely filling the negative volume, piston rod 10 encounters the blocking resistance of the oil column, so that the forward movement of the piston 12 and thus the counterrecoil of the gun barrel 5 is interrupted.

The above-described interruption of the counterrecoil which occurs after a portion of the total counterrecoil path specifically determined for the weapon in question has been travelled, remains in effect until the gun barrel 5 has pivoted about the trunnion 2 from a firing position 6 into the index position 4. Only after the index position 4 has been assumed, which may be, for example, 0° gun barrel elevation, is a valve 18 automatically opened. The valve 18 which is preferably a releasable check valve, is connected with the two cylinder chambers 14 and 16 by way of an external line (bypass conduit) 17. Upon opening (releasing) the check valve 18, the hydraulic medium, preferably oil, is able to flow back from the cylinder chamber 14 into the cylinder chamber 16 and the counterrecoil of the gun barrel may be resumed under the force of the recuperator 37 (FIG. 5). While in the closed state the check valve 18 prevents flow through the bypass conduit 17 from the chamber 14 to the chamber 16, it allows flow at all times from the chamber 16 to the chamber 14 (that is, during recoil).

Also referring to FIGS. 3 and 4, to open the valve 18 in the index position 4, a guide 29 is provided which is fixed to the turret in a manner not shown in detail and which permits valve 18 to be mechanically actuated by a release lever 30 sliding along guide 29. The guide 29 resembles a circular segment, whose center lies on the axis 2a of the trunnion 2. The guiding plane 31 of the guide 29 has a projecting cam 32 in the region of the index position 4 of the gun barrel 5. The cam 32 may have a sinusoidal cam track 33 to actuate the lever 30 which unblocks (opens) the valve 18.

Figure 8:
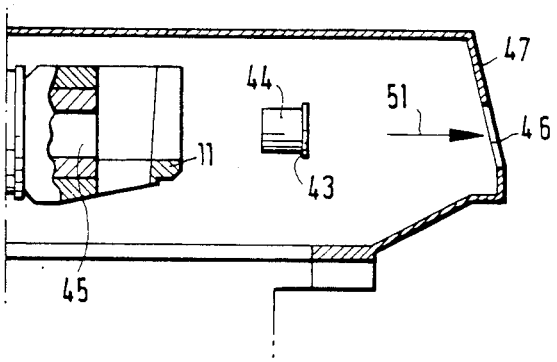
FIG. 8 is a sectional side elevational view of a rear turret half depicted in a moment of direct case ejection.
Figure 7:
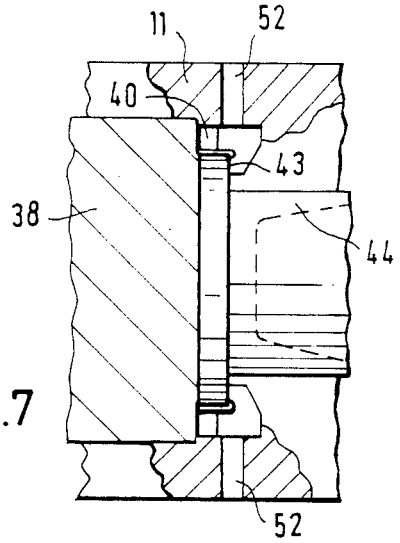
FIG. 7 is a sectional view along line VII—VII of FIG. 6.

Also referring to FIGS. 6, 7 and 8, during the counterrecoil of the gun barrel 5 in the index position 4, the wedge-type breechblock 38 in the breech ring 11 is opened in a known manner (not shown). Upon this occurrence, during a transverse motion of the wedge-type breechblock 38, the cams 39 disposed on the wedge-type breechblock 38 are displaced in a downward direction 50 and abut a stop 40 of a known case ejector 41, thus initiating a pivoting movement about the ejector axes 52. This causes ejector arms 42 disposed on both sides to transport a cartridge case 44 which has been gripped at its rear rim 43 (FIG. 7) out of chamber 45 (FIG. 8). The rotational energy of the case ejector 41 is dimensioned in such a manner that the cartridge case 44 is hurled out of the turret 47 in the direction of arrow 51 in a direct path through the breech ring 11 and through an aperture 46 in the wall of the turret 47.

It will be understood that the above description of the present invention is susceptible to various modifications, changes and adaptations, and the same are intended to be comprehended within the meaning and range of equivalents of the appended claims.

What is claimed is:

1. In a gun including a barrel arranged to execute a recoil and a counterrecoil after a shot is fired; a trunnion about which the barrel is pivotal in a vertical plane to assume an index position and firing positions situated at an angle to the index position; a case ejector for ejecting a case from the barrel during counterrecoil; the improvement comprising a counterrecoil blocking means for interrupting the counterrecoil as long as the barrel is in a firing position other than said index position and for allowing the counterrecoil to resume when the barrel assumes the index position, whereby case ejection by the case ejector is effected in the index position; said counterrecoil blocking means comprising (a) a stationary cylinder containing hydraulic fluid;

(b) a piston rod received in said cylinder and being secured at least indirectly to said barrel to move therewith as a unit during recoil and counterrecoil;

(c) a piston axially slidably received in said cylinder and being secured to said piston rod for axial movement therewith as a unit; said piston dividing said cylinder into adjacent first and second cylinder chambers; said piston having an opening for effecting hydraulic communication between said first and second cylinder chambers;

(d) a first valve means mounted on said piston and having a first position blocking said opening for preventing hydraulic communication between said first and second cylinder chambers; said first valve means having a second position unblocking said opening for allowing hydraulic communication between said first and second cylinder chambers;

(e) means for placing said first valve means into said second position during said recoil for allowing hydraulic fluid to pass from one of the cylinder chambers into the other, whereby recoil is permitted to proceed;

(f) means for placing said first valve means into said first position during said counterrecoil for preventing hydraulic fluid from passing between the cylinder chambers, whereby counterrecoil is interrupted;

(g) a bypass conduit connecting said first and second cylinder chambers with one another;

(h) a second valve means arranged in said bypass conduit and having closed and open positions for respectively blocking and unblocking said bypass conduit during counterrecoil; and (i) valve actuating means cooperating with said second valve means for placing said second valve means from the closed position into the open position when the barrel assumes said index position for allowing hydraulic liquid to pass from one of the cylinder chambers to the other through said bypass conduit, whereby counterrecoil is allowed to resume in the index position.

2. A gun as defined in claim 1, wherein said piston is hollow and has a cylindrical part in sliding contact with said cylinder and a conical part extending from an end of the cylindrical part and being connected to said piston rod; said opening being formed in said cylindrical part; said conical part having apertures for allowing passage of the hydraulic fluid; said first valve means comprising a check valve and a valve seat formed on said cylindrical part and surrounding said opening; said valve seat cooperating with said check valve.

3. A gun as defined in claim 2, further comprising a rod guide affixed to said piston rod and extending, as an axial continuation thereof, through said hollow piston; said check valve being mounted on said rod guide and being axially slidable relative thereto; said means for placing said first valve means into said second position comprising a compression spring surrounding and supported on said rod guide; said compression spring being in engagement with said check valve for urging said check valve into said valve seat.

4. A gun as defined in claim 1, further comprising a heat compensation piston slidably received in said cylinder at an end thereof; said heat compensation piston having a determined axial stroke and being arranged to execute a forward stroke into the cylinder simultaneously and codirectionally with the motion of said piston and piston rod during one part of the recoil and to execute a rearward stroke in a direction out of the cylinder simultaneously and codirectionally with the motion of said piston and piston rod during one part of the counterrecoil; further wherein the volume of said cylinder being reduced to a lesser amount by the heat compensation piston during an entire forward stroke than the amount by which the volume of said cylinder is increased due to a withdrawal of the piston rod from the cylinder during recoil.

5. A gun as defined in claim 4, further comprising a cylindrical guide member affixed to said heat compensation piston and projecting out of said cylinder; an abutment formed on said cylindrical guide member and cooperating with said cylinder for determining said axial stroke of said heat compensation piston.

6. A gun as defined in claim 5, further comprising spring means for urging said heat compensation piston into said cylinder.

7. A gun as defined in claim 1, wherein said valve actuating means comprises an actuating member for placing said second valve means into said open or closed position; said actuating member moving together with said barrel during pivotal motions; and a stationary guide cooperating with said actuating member during travel thereof with said barrel; means formed on said stationary guide for tripping said actuating member when said barrel attains said index position to place said second valve means into said open position.

8. A gun as defined in claim 7, wherein said trunnion has an axis; further wherein said stationary guide has the shape of a circular segment having a center lying on said axis of said trunnion; said means formed on said stationary guide comprises a projecting cam engaging said actuating member when said barrel attains said index position.

* * * * *